US011195650B2

(12) United States Patent
Yamamoto et al.

(10) Patent No.: US 11,195,650 B2
(45) Date of Patent: Dec. 7, 2021

(54) REACTOR

(71) Applicant: MEIDENSHA CORPORATION, Tokyo (JP)

(72) Inventors: Yuka Yamamoto, Numazu (JP); Keiichi Kodachi, Numazu (JP); Kuan Chung Tey, Numazu (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 17/274,523

(22) PCT Filed: May 22, 2019

(86) PCT No.: PCT/JP2019/020235
§ 371 (c)(1),
(2) Date: Mar. 9, 2021

(87) PCT Pub. No.: WO2020/066122
PCT Pub. Date: Apr. 2, 2020

(65) Prior Publication Data

US 2021/0249173 A1 Aug. 12, 2021

(30) Foreign Application Priority Data

Sep. 28, 2018 (JP) ..... JP2018-183871
Apr. 26, 2019 (JP) ..... JP2019-084897

(51) Int. Cl.
*H01F 27/16* (2006.01)
*H01F 27/02* (2006.01)
(Continued)

(52) U.S. Cl.
CPC ..... *H01F 27/16* (2013.01); *H01F 27/025* (2013.01); *H01F 27/292* (2013.01); *H01F 37/00* (2013.01)

(58) Field of Classification Search
CPC ..... H01F 27/16; H01F 27/025; H01F 27/292; H01F 37/00
See application file for complete search history.

(56) References Cited

U.S. PATENT DOCUMENTS

2007/0295715 A1* 12/2007 Saka ..... H01F 27/22 219/624
2015/0245535 A1 8/2015 Fujita et al.
(Continued)

FOREIGN PATENT DOCUMENTS

CN 102782783 A 11/2012
JP 2007-335833 A 12/2007
(Continued)

OTHER PUBLICATIONS

Chinese Office Action and English translation, Application No. 201980060148.5, dated Jul. 1, 2021, 12 pages.

*Primary Examiner* — Elvin G Enad
*Assistant Examiner* — Malcolm Barnes
(74) *Attorney, Agent, or Firm* — Foley & Lardner LLP

(57) ABSTRACT

A box-shaped inner case (3) is accommodated in a box-shaped outer case (2), and refrigerant flow passages (27) are formed at five surfaces except an opening surface (24) by gaps between the inner and outer cases. A Gap of an opening edge of the outer case (2) and an opening edge of the inner case (3) is covered with a frame-shaped cover (6). A coil (4) is placed in the inner case (3), and the inner case (3) is filled with magnetic powder mixture resin so that the coil (4) except the terminals (4*a*, 4*b*) is embedded. A core (5) is made of the magnetic powder mixture resin. Cooling water flows along a longitudinal direction of the outer case (2) with one of refrigerant pipe connecters (15) being a refrigerant inlet and the other of the refrigerant pipe connecters (15) being a refrigerant outlet.

11 Claims, 16 Drawing Sheets

(51) Int. Cl.
*H01F 27/29* (2006.01)
*H01F 37/00* (2006.01)

(56) References Cited

U.S. PATENT DOCUMENTS

| | | | | |
|---|---|---|---|---|
| 2015/0357109 | A1* | 12/2015 | Nobusaka | H01F 27/08 336/58 |
| 2018/0233266 | A1* | 8/2018 | Tsukada | H01F 27/306 |
| 2020/0176168 | A1* | 6/2020 | Tanabe | H01F 27/16 |

FOREIGN PATENT DOCUMENTS

| | | | | |
|---|---|---|---|---|
| JP | 2009-49082 | A | | 3/2009 |
| JP | 2009-218417 | A | | 9/2009 |
| JP | 2010-3838 | A | | 1/2010 |
| JP | 2016-219563 | A | | 12/2016 |
| JP | 2016219563 | A | * | 12/2016 |
| JP | 2017-092169 | A | | 5/2017 |
| JP | 2019-36609 | A | | 3/2019 |

* cited by examiner

REACTOR

TECHNICAL FIELD

The present invention relates to a reactor used for a power conversion device etc., and more particularly to a reactor having a cooling mechanism.

BACKGROUND ART

As one of components forming a power conversion device such as an inverter, a reactor including a coil and a core is used. Although, for size reduction of the power conversion device, there is a need to reduce sizes of the components forming the power conversion device, in order to reduce a size of the reactor as a typical component forming the power conversion device, it is necessary to efficiently cool the reactor that is a heat-generating component. The reactor is a component having a large heat value, and thus reducing heat damage to other components which is caused by heat generation of the reactor has to be taken into consideration.

Patent Document 1 discloses a reactor having a structure in which a cooler formed from a plate-shaped heat sink is provided along a side surface of a coil wound around a core, and potting material is injected so as to fill a gap between the cooler and the coil. A part of the coil is embedded in the potting material, and lead wires of the coil are led out through the potting material. The cooler has, on an outside surface thereof, heat radiation fins, and performs a cooling function by or through the outside air.

Patent Document 2 discloses a water-cooled reactor having a structure in which a coil is accommodated in a case, a core is formed by filling an inside and an outside of the coil (a space between the coil and the case) with magnetic powder-containing resin, and cooling pipes are provided with the cooling pipes passing through the core. The cooling pipes are made of aluminium, and are embedded in the core made of the magnetic powder-containing resin.

In a case of the structure of Patent Document 1, by cooling the lead wires, which serve as terminals of the reactor, of the coil through the potting material, it is possible to obtain a function of suppressing heat that is transferred to other components connected to the terminals of the reactor through these terminals. However, it is not possible to reduce heat that is transferred, through the air or by radiation, to other components not connected to the terminals of the reactor from the coil and/or the core. In particular, since the coil and the core are exposed except for their surfaces contacting the cooler, it is not possible to intercept or cut out the heat transferred to other components.

In a case of the structure of Patent Document 2, although the metal cooling pipes are arranged with the cooling pipes passing through the case, in order to secure an insulation distance between the coil and each cooling pipe and satisfy a reactor performance, there are restrictions on position of the cooling pipe. Therefore, reduction in size of the case including the cooling pipes is difficult. Further, sufficient recovery of heat at a portion separated from the cooling pipe cannot be performed, and the whole cooling is not possible. As a consequence, there is a concern that heat will be transferred from a relatively high temperature portion to other components.

CITATION LIST

Patent Document

Patent Document 1: Japanese Unexamined Patent Application Publication No. 2017-092169

Patent Document 2: Japanese Unexamined Patent Application Publication No. 2007-335833

SUMMARY OF THE INVENTION

A reactor according to one aspect of the present invention comprises: a box-shaped inner case whose one side surface is an opening surface; an outer case enclosing outer sides of surfaces except the opening surface of the inner case, forming gaps that serve as refrigerant flow passages between the inner case and the outer case and provided with a refrigerant inlet and a refrigerant outlet; a coil placed in the inner case through the opening surface, terminals at both ends of the coil being arranged at the opening surface; and a core made of magnetic powder mixture resin that fills the inner case so that the coil except the terminals is embedded.

In this configuration, a refrigerant flowing into the outer case from the refrigerant inlet flows in the reactor through the refrigerant flowpassages that enclose all the surfaces except the opening surface where the terminals are arranged. With this, peripheries of the coil and the core are enclosed by the refrigerant flow passages, then the coil and the core are effectively cooled. In particular, since the core made of the magnetic powder mixture resin is in absolute contact with inner wall surfaces of the inner case and heat is surely transferred to the refrigerant through the inner case, the heat is effectively recovered. Further, since outside surfaces of the outer case are substantially thermally insulated from the coil by the refrigerant flow passages, temperature of any of the outside surfaces, except the opening surface, of the outer case is kept down. Therefore, thermal influence on other components that are adjacent to the reactor is reduced.

As another aspect of the present invention, a reactor comprises: a box-shaped inner case whose one side surface is an opening surface; an outer case enclosing outer sides of surfaces except the opening surface of the inner case, forming gaps that serve as refrigerant flow passages between the inner case and the outer case and provided with a refrigerant inlet and a refrigerant outlet; a reactor assembly placed in the inner case through the opening surface and including a coil and a core, terminals at both ends of the coil being arranged at the opening surface; and a thermal conductive potting material filling the inner case so that the coil except the terminals is embedded.

Also in this configuration, likewise, since the refrigerant flow passages enclose all the surfaces except the opening surface where the terminals are arranged and the refrigerant flows in the reactor through the refrigerant flow passages from the refrigerant inlet to the refrigerant outlet, the reactor assembly whose periphery is enclosed with refrigerant flow passages is effectively cooled. The reactor assembly including the coil and the core is embedded in the thermal conductive potting material, and this thermal conductive potting material is in absolute contact with the inner wall surfaces of the inner case. Therefore, since heat is surely transferred to the refrigerant through the inner case, the heat is effectively recovered. Further, since the outside surfaces of the outer case are substantially thermally insulated from the coil by the refrigerant flow passages, temperature of any of the outside surfaces, except the opening surface, of the outer case is kept down. Therefore, thermal influence on other components that are adjacent to the reactor is reduced.

As the refrigerant, for instance, a liquid phase refrigerant such as cooling water containing water as a main component and cooling oil (e.g. mineral oil) having insulation property can be used. Further, a gaseous refrigerant or a gas-liquid mixture type refrigerant could be used.

As a preferable reactor, the inner case and the outer case each have a rectangular parallelepiped box shape, one side surface, corresponding to the opening surface of the inner case, of the outer case is an opening surface, and the inner case can be installed in the outer case through the opening surface of the outer case, and the refrigerant inlet is provided at one end portion in a longitudinal direction of the outer case, and the refrigerant outlet is provided at the other end portion of the outer case.

Therefore, the refrigerant flows along a longitudinal direction of the inner and outer cases having the rectangular parallelepiped box shape, and a heat exchange is effectively performed. Further, five surfaces, except the opening surface where the terminals are arranged, out of six surfaces of the rectangular parallelepiped shape are enclosed with the refrigerant flow passages.

As one aspect of the present invention, the reactor further comprises a frame-shaped cover fixed to the one side surface, serving as the opening surface, of the outer case and covering a gap between the opening surface of the outer case and the inner case. Although the opening surface of the outer case is so larger than the inner case that the inner case is able to be installed in the outer case, the frame-shaped cover covers the gap between the outer case and the inner case, then the refrigerant flow passages are hermetically sealed.

A cooling fin could be provided at least at a part of outside surfaces, which are in contact with the refrigerant flow passages, of the inner case. By this cooling fin, a heat exchange area becomes large.

Further, as one aspect of the present invention, the inner case is filled with insulating oil serving as the refrigerant without using the potting material.

That is, a reactor comprises: a box-shaped inner case whose one side surface is an opening surface and which is filled with insulating oil serving as a refrigerant and has a communication hole through which the insulating oil can flow; an outer case enclosing outer sides of surfaces except the opening surface of the inner case, forming gaps that serve as refrigerant flow passages between the inner case and the outer case and provided with a refrigerant inlet and a refrigerant outlet; a reactor assembly placed in the inner case through the opening surface and including a coil and a core, terminals of the coil being arranged at the opening surface; and a lid member covering the opening surface with the terminals being led out.

In this configuration, the inner case is filled with the insulating oil through the communication hole. By and through this insulating oil, the reactor assembly is insulated, and also heat is transferred from the reactor assembly to the inner case. Then, the insulating oil flowing in the refrigerant flow passages between the inner case and the outer case cools the inner case, which in turn cools the reactor assembly. Here, as long as the refrigerant flow passages and an inside of the inner case communicate with each other through the communication hole such that the inside of the inner case is filled with the insulating oil, the insulating oil does not necessarily need to actively flow in the inner case.

According to the reactor of the present invention, all the surfaces except the opening surface, where the terminals are arranged, of the inner case accommodating therein the coil and the core are enclosed with the refrigerant flow passages, then the coil and the core are effectively cooled. In particular, since the magnetic powder mixture resin serving as the core, the potting material or the insulating oil fills the inner case and is in absolute contact with the inner wall surfaces of the inner case, heat is surely recovered by the refrigerant. Moreover, since the outside surface temperature of the outer case becomes lower, thermal influence on other components is reduced.

EMBODIMENTS FOR CARRYING OUT THE INVENTION

In the following description, embodiments of a reactor 1 according to the present invention will be explained in detail with reference to the drawings.

Figure 1:
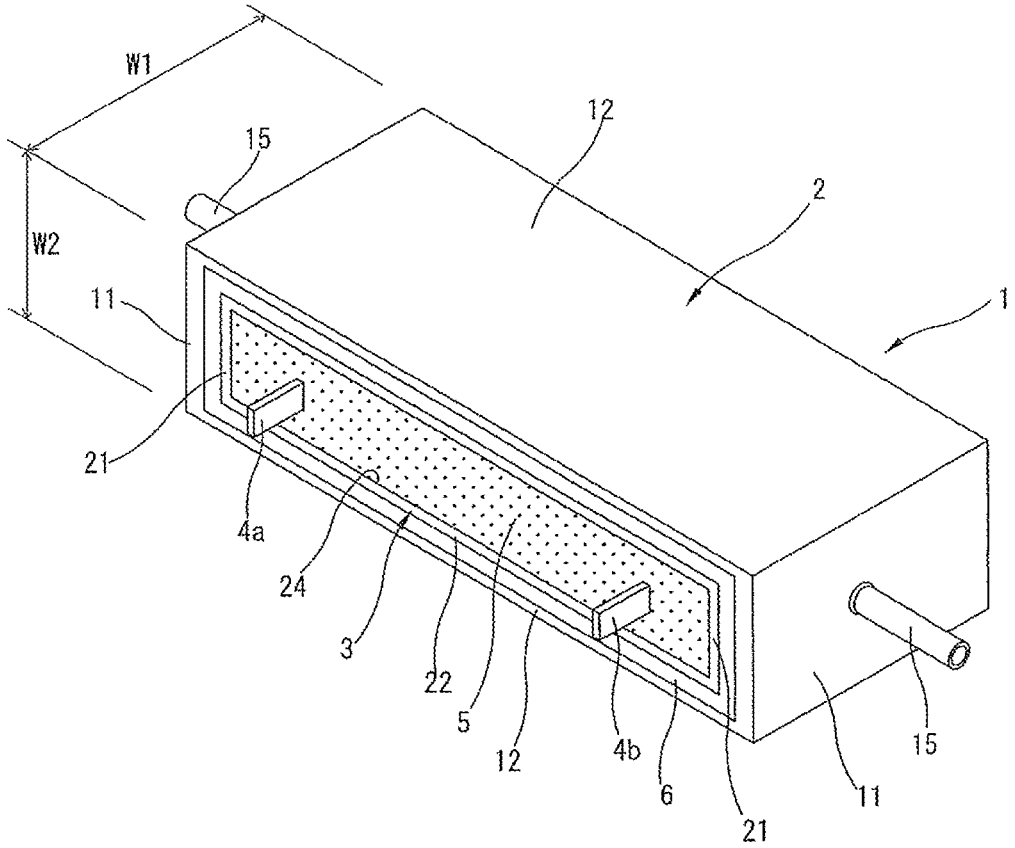
FIG. 1 is a perspective view showing a first embodiment of a reactor.
Figure 2:
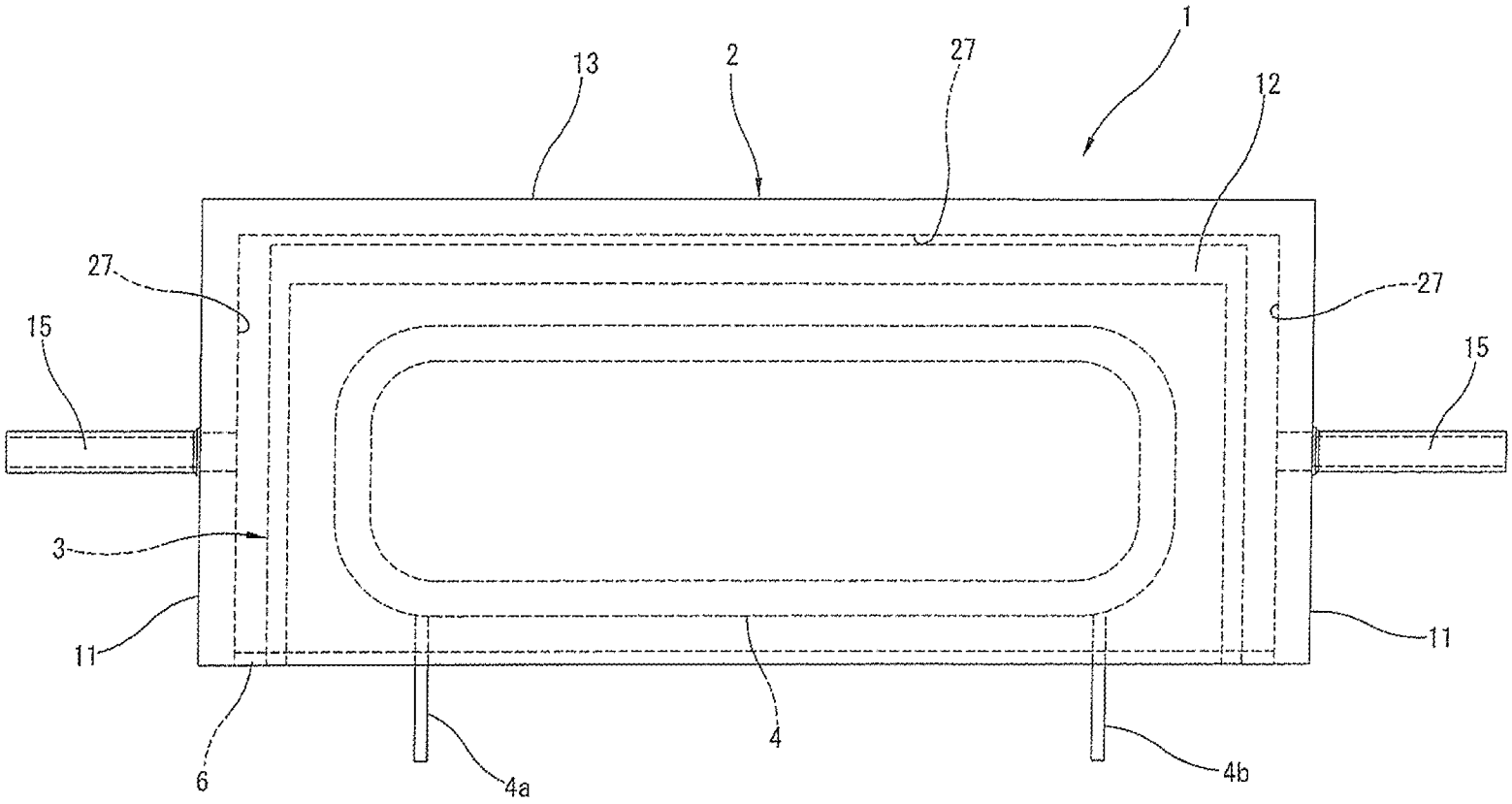
FIG. 2 is a plan view of the reactor of the first embodiment.
Figure 3:
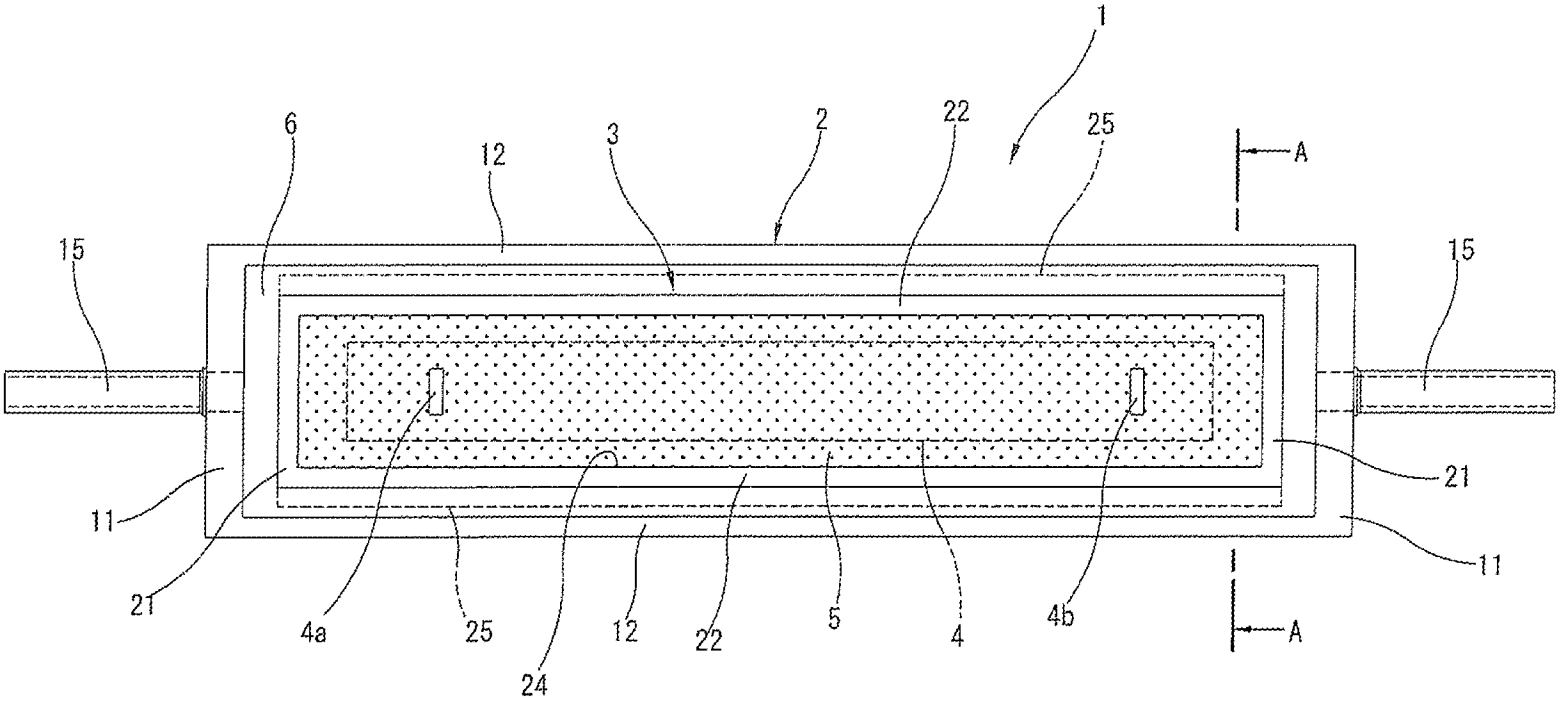
FIG. 3 is a front view of the reactor of the first embodiment.
Figure 4:
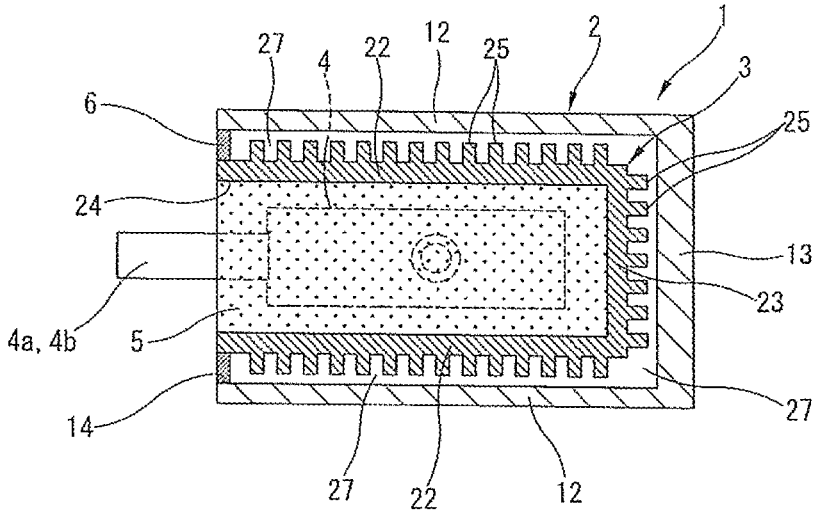
FIG. 4 is a sectional view taken along an A-A line of FIG. 3.
Figure 5:
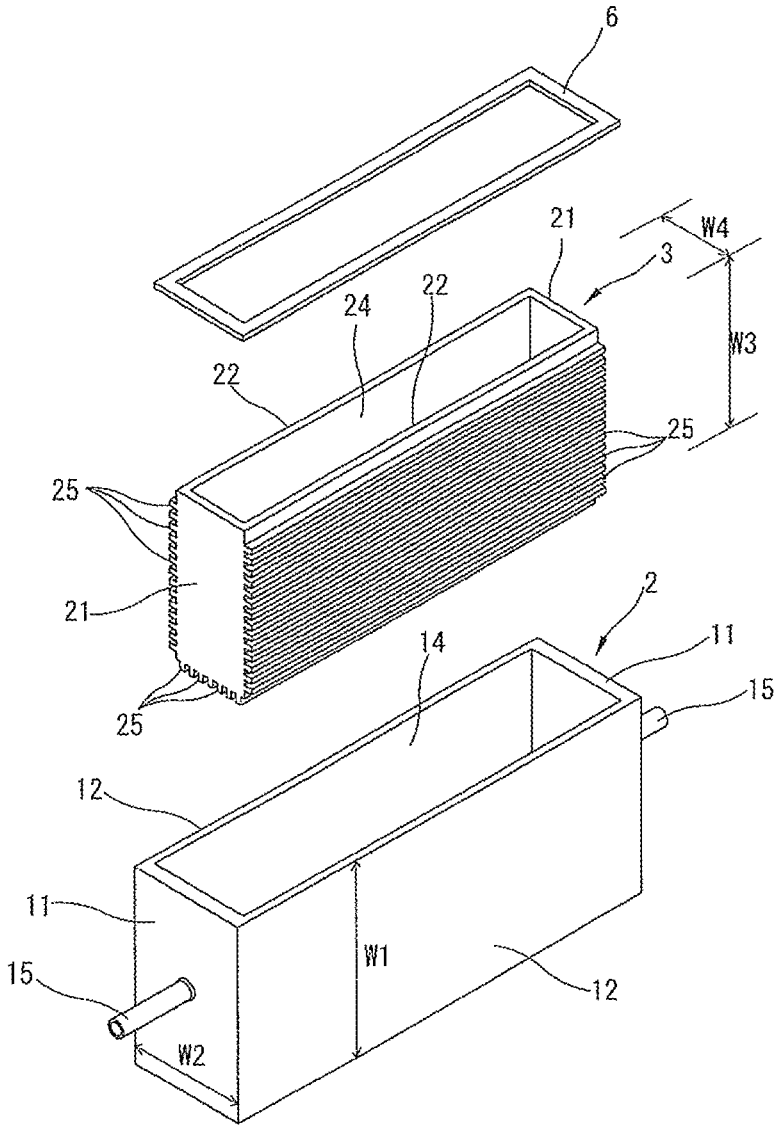
FIG. 5 is a perspective exploded view showing an outer case and an inner case.

FIG. 1 is a perspective view showing a first embodiment of the reactor 1 used as a component forming an inverter for, for instance, an electric vehicle and a hybrid vehicle. FIG. 2 is a plan view of the reactor 1 of the first embodiment. FIG. 3 is a front view of the reactor 1 of the first embodiment. FIG. 4 is a sectional view taken along an A-A line of FIG. 3. The reactor 1 has an outer case 2 having a rectangular parallelepiped shape, as shown in FIG. 4, an inner case 3 having a similar rectangular parallelepiped shape and accommodated in the outer case 2, a coil 4 placed in the inner case 3 and a care 5 accommodated in the inner case 3 together with the coil 4. FIG. 5 is a perspective exploded view showing the outer case 2 and the inner case 3. For such reactor 1 mounted in the vehicle, since the coil 4 generates heat and also temperature (ambient temperature) of an atmosphere such as an engine room where the reactor 1 is located can be relatively high (as an example, over 100° C.), forcible cooling using refrigerant is required. In the first embodiment, as the refrigerant, for instance, cooling water containing water as a main component is used.

The outer case 2 is made of metal, preferably metal that is excellent in heat conduction. The outer case 2 is formed as a single-piece case by, e.g. cutting or aluminum die casting of aluminum alloy base material. The outer case 2 has a box shape whose one side surface out of six surfaces forming the rectangular parallelepiped is open. That is, the outer case 2 has a pair of end walls 11 forming end surfaces of both ends in a longitudinal direction of the outer case 2, a pair of side walls 12 forming side surfaces each having a relatively wide width (W1), a bottom wall 13 forming a side surface having a relatively narrow width (W2) and an opening surface 14 corresponding to a side surface having the relatively narrow width (W2) and facing the bottom wall 13. Further, a rectangular frame-shaped cover 6 is fixed to the opening surface 14.

Refrigerant pipe connecters 15, one of which serves as a refrigerant inlet and the other of which serves as a refrigerant outlet, are connected to center portions of the pair of end walls 11. These refrigerant pipe connecters 15 each have a circular tubular shape extending along the longitudinal direction of the outer case 2, and are connected to a cooling water circulation system (not shown) including a pump (not shown).

In the same manner as the outer case 2, the inner case 3 is made of metal, preferably metal that is excellent in heat conduction. The inner case 3 is formed as a single-piece case by, e.g. cutting or aluminum die casting of aluminum alloy base material. The inner case 3 has the rectangular parallelepiped shape that is substantially a similar figure to the outer case 2 and smaller than the outer case 2. In the same manner as the outer case 2, the inner case 3 is formed into a box shape whose one side surface out of six surfaces forming the rectangular parallelepiped is open. That is, as shown in the perspective exploded view of FIG. 5, the inner case 3 has a pair of end walls 21 forming end surfaces of both ends in a longitudinal direction of the inner case 3, a pair of side walls 22 forming side surfaces each having a relatively wide width (W3), a bottom wall 23 forming a side surface having a relatively narrow width (W4) and an opening surface 24 corresponding to a side surface having the relatively narrow width (W4) and facing the bottom wall 23. A number of cooling fins 25 extending straight along the longitudinal direction of the inner case 3 are formed on surfaces of the pair of side walls 22 and the bottom wall 23. For instance, a number of cooling fins 25 are arranged on all surfaces of the side walls 22 and the bottom wall 23 at regular pitches.

The opening surface 24 of the inner case 3 is located at a surface corresponding to the opening surface 14 of the outer case 2. That is, in a state in which the outer case 2 and the inner case 3 are combined together, the opening surface 24 of the inner case 3 is positioned in the opening surface 14 of the outer case 2. Then, between the inner case 3 and the outer case 2 at the respective five surfaces except these opening surfaces 14 and 24, gaps serving as refrigerant flow passages 27 are formed. In other words, the outer case 2 encloses outer sides of the five surfaces except the opening surface 24 of the inner case 3, and the refrigerant flow passages 27 are formed at the respective surfaces. As shown in FIG. 4, although the cooling fins 25 of the inner case 3 protrude so as to approach inner wall surfaces of the outer case 2, top edges of the cooling fins 25 do not touch the inner wall surfaces of the outer case 2, and slight gaps exist so that the cooling water can flow through or across the cooling fins 25.

The frame-shaped cover 6 is provided between an opening edge of the outer case 2 and an opening edge of the inner case 3, and closes opening surfaces of the refrigerant flow passages 27 formed between them. For instance, as an example, the cover 6 is formed from a metal plate whose material is same as those of the outer case 2 and the inner case 3, and its outer peripheral edge is welded (or brazed) to the opening edge of the outer case 2 and its inner peripheral edge is welded (or brazed) to the opening edge of the inner case 3. With this structure, the refrigerant flow passages 27 are hermetically sealed, and the outer case 2 and the inner case 3 are firmly integrated. Alternatively, the cover 6 could be fixed to the outer case 2 and the inner case 3 with screws etc., and their mating surfaces could be sealed with sealant such as a liquid gasket. Alternatively, a portion corresponding to the cover 6 may be formed integrally with the inner case 3, and this portion may be welded (or brazed) or screwed to the opening edge of the outer case 2.

As shown in FIG. 6, the coil 4 accommodated in the inner case 3 is a coil formed by winding a wire in a shape along a substantially flat rectangular shape so as to correspond to the rectangular parallelepiped shape of the inner case 3. For instance, as the wire, a wire (so-called flat-type wire) having a rectangular cross section whose cross-sectional area is relatively large is used, and this wire is helically wound in a radial direction without overlapping. Then, both ends of the wire are led out as terminals 4*a* and 4*b*. These two terminals 4*a* and 4*b* are positioned apart from each other at both end portions in a longitudinal direction of the coil 4 having a long narrow shape as a whole, and extend parallel to each other. It is noted that the coil 4 is wound such that a center axis (a magnetic center axis) of the coil 4 is orthogonal to the side surface (the side wall 22), having a wider width, of the inner case 3.

The coil 4 is placed in the inner case 3 with the pair of terminals 4*a* and 4*b* protruding from the opening surface 24. Then, the inner case 3 is filled with magnetic powder mixture resin (or magnetic powder-containing resin) so that the coil 4 except the terminals 4*a* and 4*b* is embedded. The core 5 is formed by this magnetic powder mixture resin.

As the magnetic powder mixture resin, for instance, resin obtained by mixing magnetic powder such as iron and ferrite with thermosetting resin such as epoxy resin and phenol resin that are in liquid form having proper fluidity when not cured is used. In this case, after the magnetic powder mixture resin in liquid form is injected into the inner case 3 in which the coil 4 is placed or the inner case 3 in which the coil 4 is placed is filled with the magnetic powder mixture resin in liquid form, the magnetic powder mixture resin is cured by application of heat in a heating furnace, then the core 5 is formed. Alternatively, magnetic powder could be mixed with thermoplastic resin, and this mixture resin could be ejected into the inner case 3 in a melted state. Alternatively, in the same way as forming of so-called dust core (or pressed powder core), the inner case 3 may be filled with magnetic powder whose surface is previously coated with resin that serves as a binder, and the core 5 may be formed by pressurizing and heating this magnetic powder.

Here, order of two steps of assembly of the cases 2 and 3 and filling and forming of the core 5 is arbitrarily determined. That is, after assembling the outer case 2 and the inner case 3, the coil 4 could be placed in the inner case 3 and the inner case 3 could be filled with the magnetic powder mixture resin. Alternatively, after placing the coil 4 in the inner case 3 and filling the inner case 3 with the magnetic powder mixture resin, this inner case 3 and the outer case 2 could be assembled. In a case of the embodiment in which the outer case 2 and the inner case 3 are integrated by the cover 6 being welded or brazed, after integrating the outer case 2 and the inner case 3, insertion or installation of the coil 4 and forming of the core 5 are carried out.

Figure 6A:
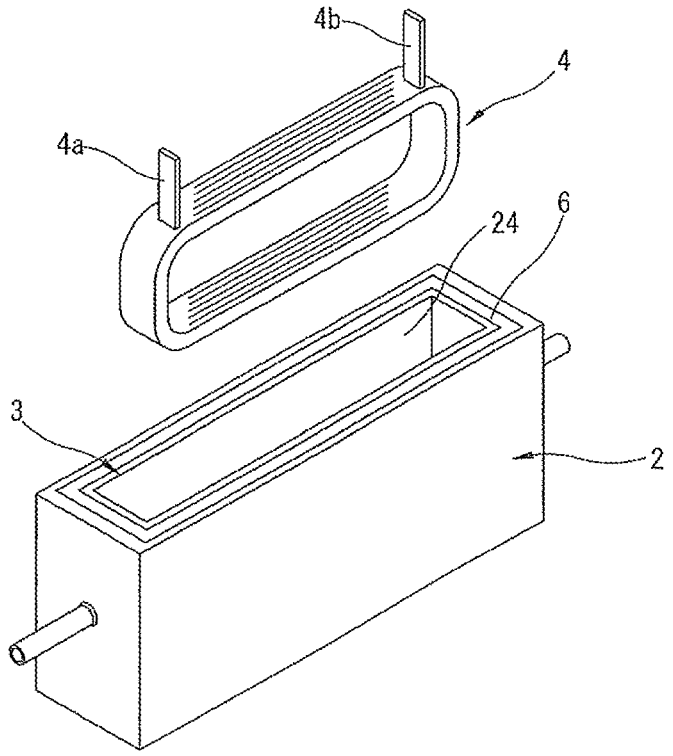
FIGS. 6A and 6B are explanatory drawings showing a manufacturing process of the reactor of the first embodiment.
Figure 6B:
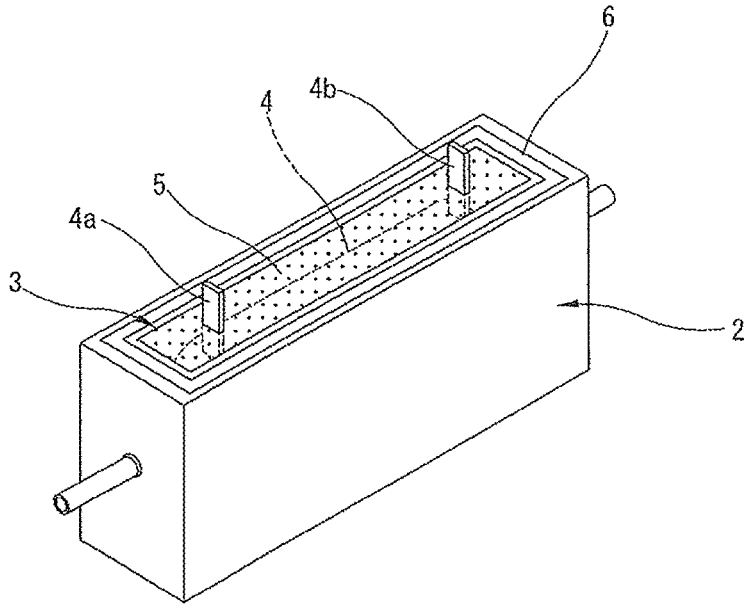

FIGS. 6A and 6B show an example of a manufacturing process of the reactor 1. After integrating the outer case 2 and the inner case 3, as shown in FIG. 6A (step A), the coil 4 is inserted and placed in the inner case 3. Subsequently, as shown in FIG. 6B (step B), the magnetic powder mixture resin is injected into the inner case 3 or the inner case 3 is filled with the magnetic powder mixture resin, and the core 5 is formed.

Figure 7A:
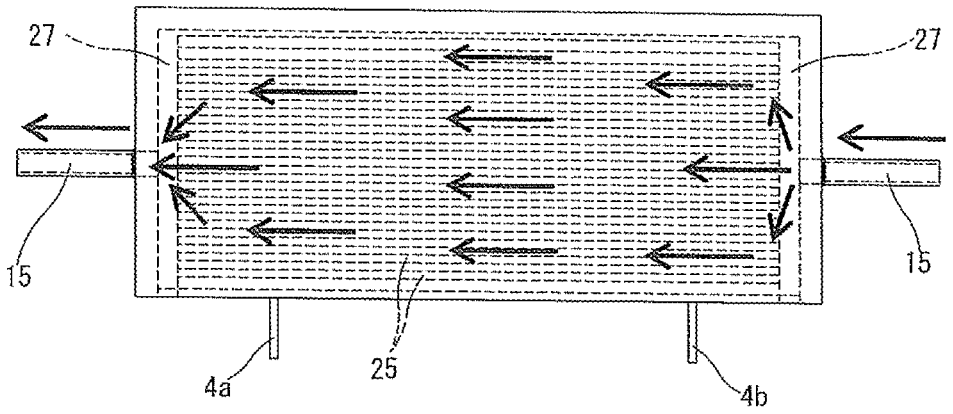
FIGS. 7A and 7B are explanatory drawings showing flows of cooling water, corresponding to the plan view and the front view respectively.
Figure 7B:
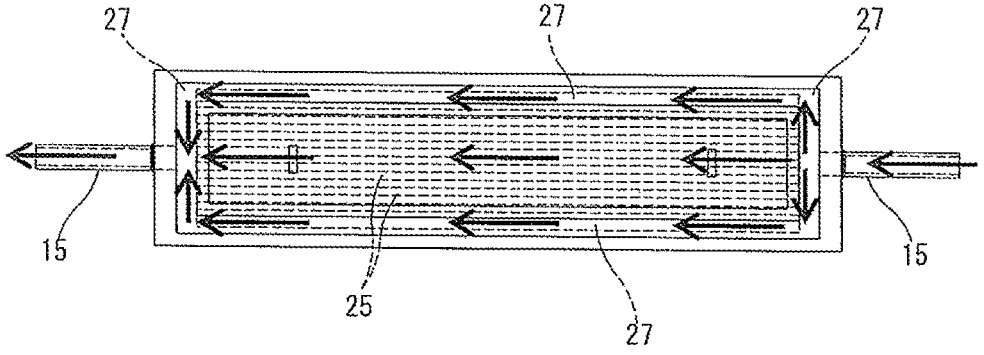

In the reactor 1 structured as described above, one of the refrigerant pipe connecters 15 of the outer case 2 serves as the refrigerant inlet, and the other serves as the refrigerant outlet, then the cooling water forcibly flows by the pump (not shown). FIGS. 7A and 7B are explanatory drawings showing flows of the cooling water in the reactor 1 by arrows. As shown in FIGS. 7A and 7B, the cooling water flowing into the reactor 1 from the refrigerant inlet radially expands in the refrigerant flow passage 27 between the one end wall 11 of the outer case 2 and the one end wall 21 of the inner case 3. The cooling water further flows in the refrigerant flow passages 27 between the side walls 12 of the outer case 2 and the side walls 22 of the inner case 3 and between the bottom wall 13 of the outer case 2 and the bottom wall 23 of the inner case 3 along the longitudinal directions of these cases 2 and 3. Then, the cooling water flows in the refrigerant flow passage 27 between the other end wall 11 of the outer case 2 and the other end wall 21 of the inner case 3, and flows out of the reactor 1 through the refrigerant outlet. That is, the cooling water flows along the respective five surfaces, except the opening surfaces 14 and 24 where the terminals 4*a* and 4*b* are arranged, of the cases 2 and 3, and effectively cools the coil 4 and the core 5 which are enclosed with these five surfaces. In particular, since the core 5 made of the magnetic powder mixture resin is in absolute contact with inner wall surfaces of the inner case 3 and heat is surely transferred to the cooling water through the inner case 3, the heat is effectively recovered. The inner case 3 is provided with the cooling fins 25, and thus a heat exchange area between the inner case 3 and the cooling water becomes large, thereby improving heat transfer from the inner case 3 to the cooling water. Further, since outside surfaces of the outer case 2 are substantially thermally insulated from the inner case 3 by the refrigerant flow passages 27, temperature of any of the outside surfaces except the opening surface 14 of the outer case 2 becomes lower. Therefore, thermal influence on other components that are adjacent to the reactor 1 is reduced.

Here, in the embodiment, since the side surfaces each having the relatively narrow width, out of respective four side surfaces extending along the longitudinal direction of the rectangular parallelepiped shapes of the cases 2 and 3, are the opening surfaces 14 and 24, an area of a portion having no refrigerant flow passage 27 becomes the minimum. In other words, an area of a surface covered with the refrigerant flow passages 27 is increased to the maximum, and the coil 4 and the core 5 are effectively cooled, and also heat radiation to the outside is reduced. As mentioned above, for the reactor 1 for the vehicle, even though the coil 4 is a heating element (a heat generator) and also a surrounding atmosphere (ambient temperature) becomes high, since the cooling water flows in a wide area, it is possible to maintain the coil 4 and the outer case 2 at relatively low temperature.

In the illustrated example, the cooling fins 25 are provided on the three surfaces of the side walls 22 and the bottom wall 23 of the inner case 3 which are outside surfaces of the inner case 3. However, the cooling fins 25 could be provided on one or two surf aces. Alternatively, by taking account of balance between pressure loss and flow amount and/or reduction in machining cost, a structure having no cooling fin 25 could be possible.

Further, in the illustrated example, the refrigerant pipe connecters 15, one of which serves as the refrigerant inlet and the other of which serves as the refrigerant outlet, are fixed to the respective middle portions of the end walls 11 of the outer case 2. However, as long as the refrigerant inlet and the refrigerant outlet communicate with the respective refrigerant flow passages 27 (i.e. the refrigerant flow passages 27 at the both end portions in the longitudinal direction) formed between the end walls 11 of the outer case 2 and the end walls 21 of the inner case 3, other structures could be employed. For instance, in order to avoid interference between the refrigerant pipe connecters 15 and other components, refrigerant pipe connecters 15 that extend parallel to the surfaces of the end walls 11 may be connected to respective end portions of the side walls 12 or the bottom wall 13 of the outer case 2 (more specifically, to areas located at outer sides with respect to outside surfaces of the terminals 4*a* and 4*b* in the longitudinal direction of the outer case 2).

Figure 8:
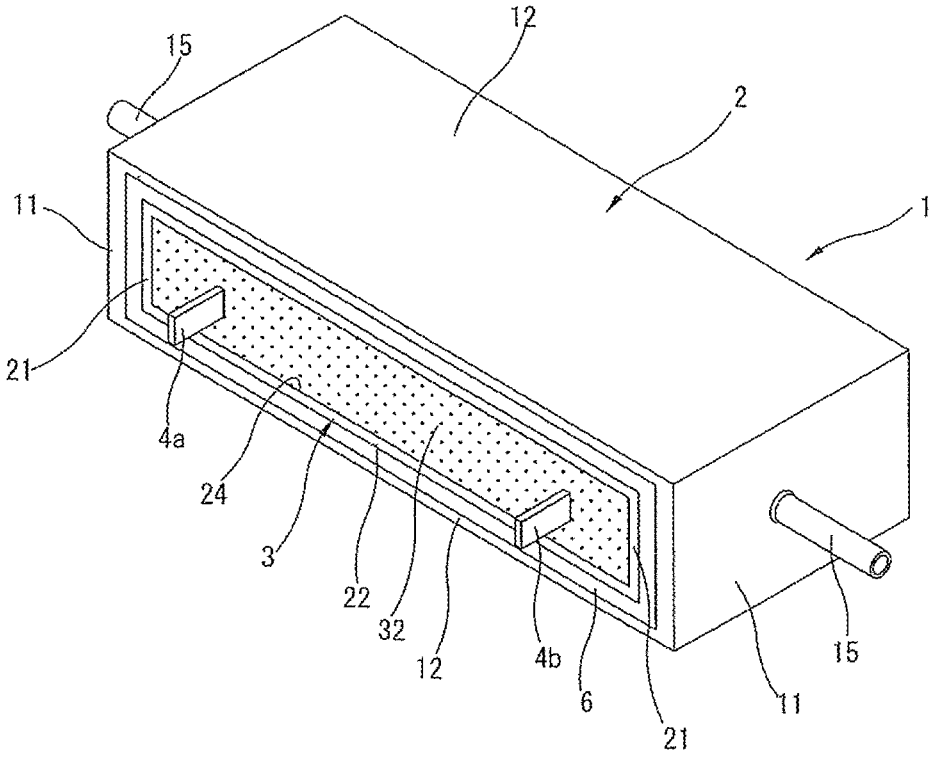
FIG. 8 is a perspective view showing a second embodiment of the reactor.
Figure 9:
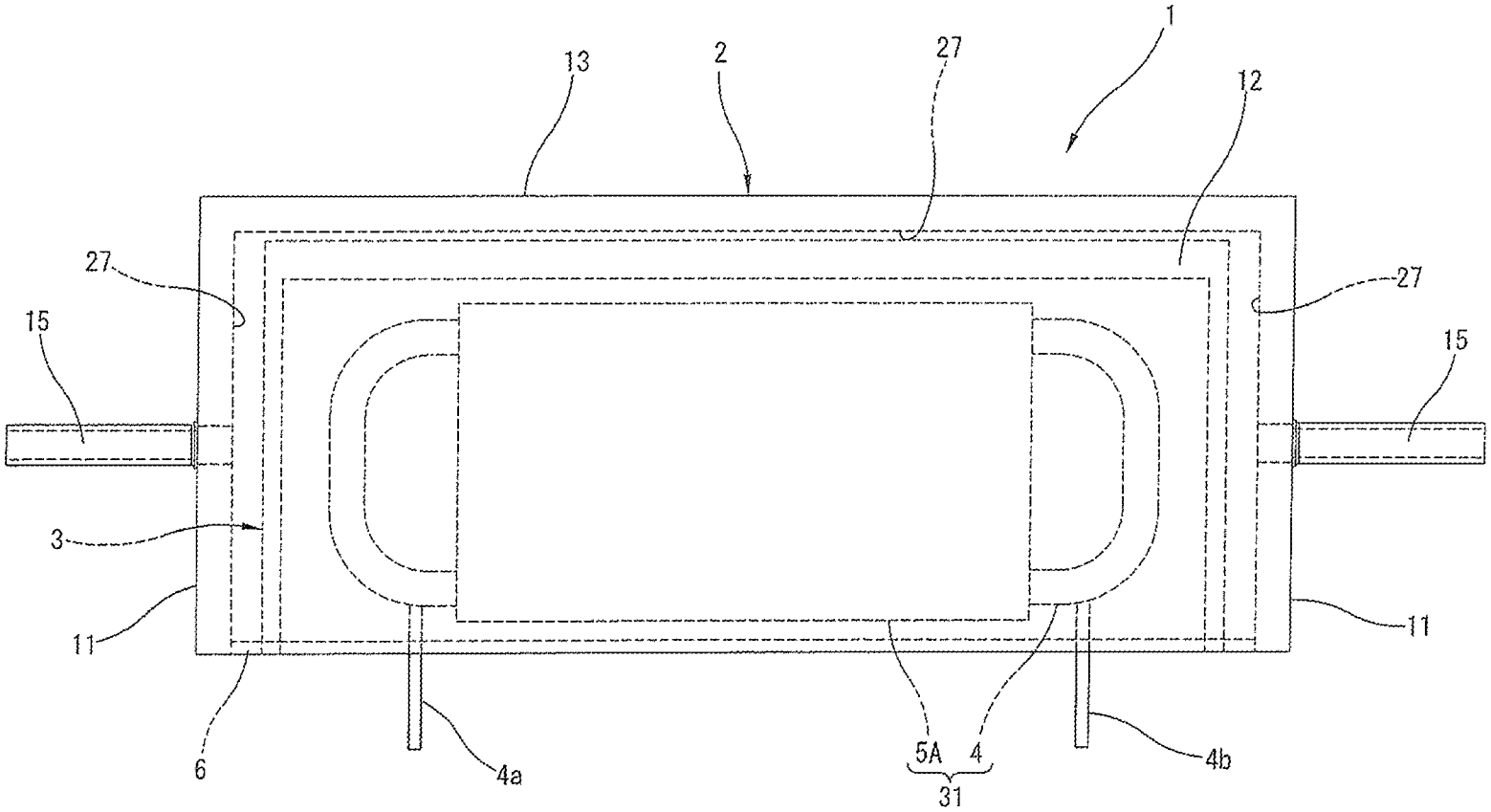
FIG. 9 is a plan view of the reactor of the second embodiment.
Figure 10:
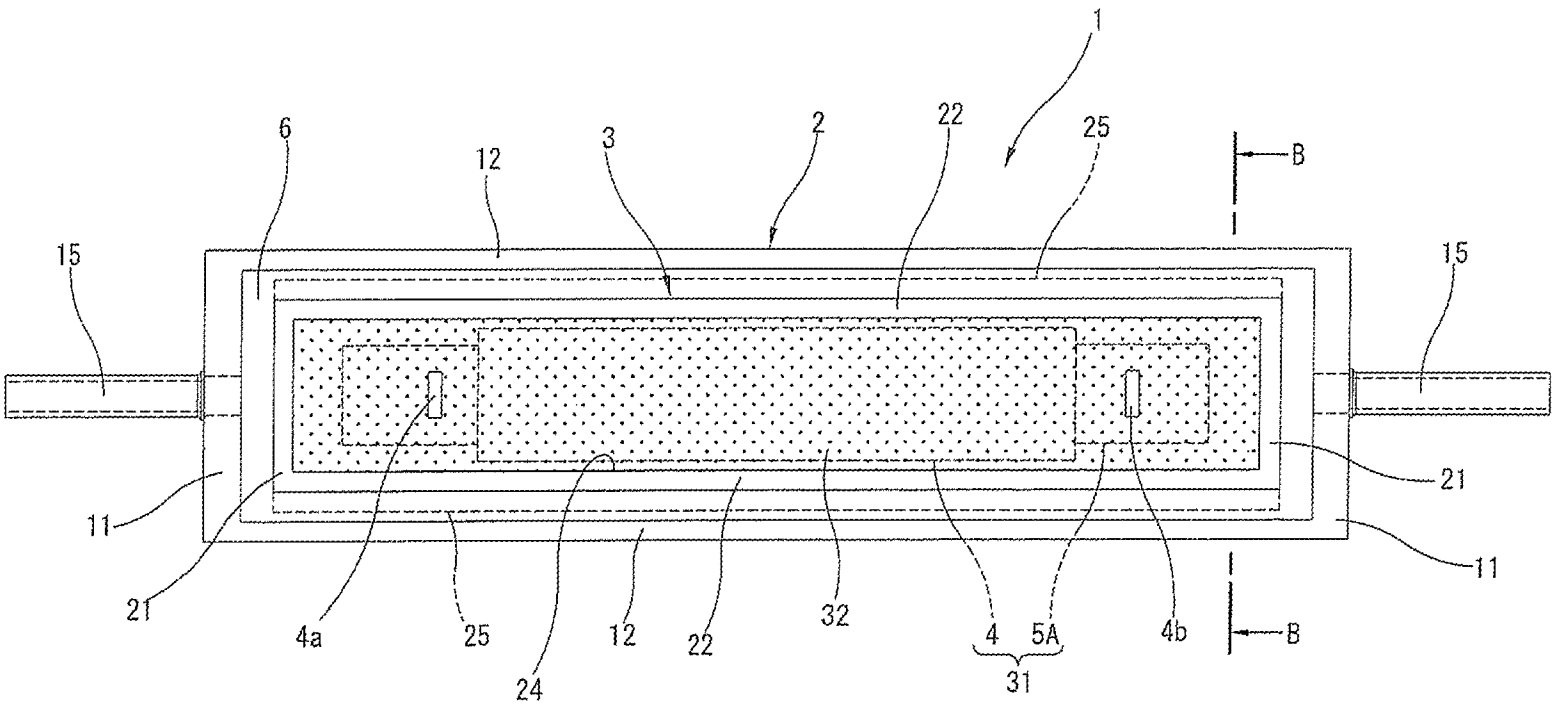
FIG. 10 is a front view of the reactor of the second embodiment.
Figure 11:
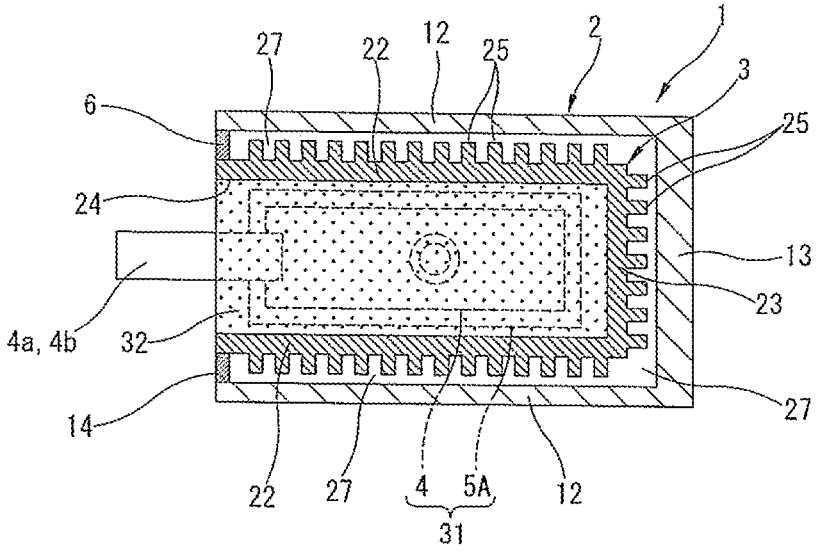
FIG. 11 is a sectional view taken along a B-B line of FIG. 10.

Next, a second embodiment of the reactor 1 will be explained with reference to FIGS. 8 to 13A and 13B. Here, basically the same element or component as that of the first embodiment is denoted by the same reference sign, and its explanation will be omitted below. FIG. 8 is a perspective view of the reactor 1 of the second embodiment. FIG. 9 is a plan view of the reactor 1 of the second embodiment. FIG. 10 is a front view of the reactor 1 of the second embodiment. FIG. 11 is a sectional view taken along a B-B line of FIG. 10.

Figure 12:
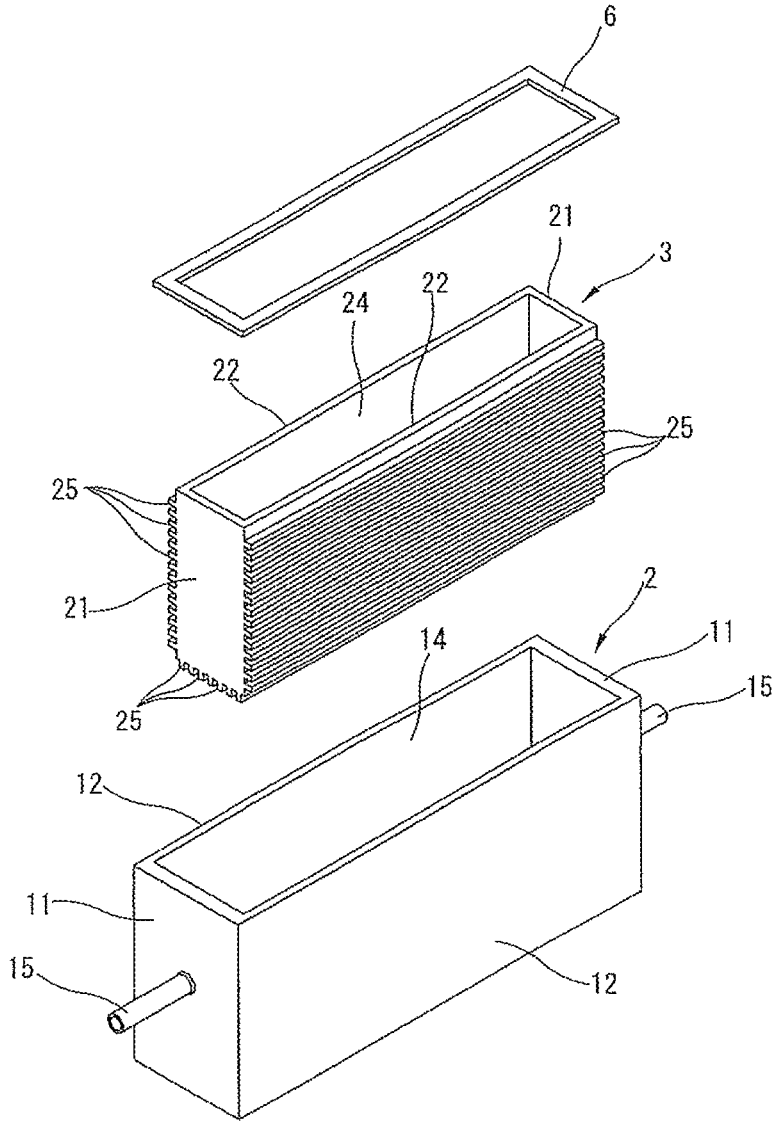
FIG. 12 is a perspective exploded view showing the outer case and the inner case.

In the same manner as the reactor 1 of the first embodiment, the reactor 1 has the outer case 2 having a rectangular parallelepiped shape, the inner case 3 having a similar rectangular parallelepiped shape and accommodated in the outer case 2 and the rectangular frame-shaped cover 6 provided between the opening edge of the outer case 2 and the opening edge of the inner case 3. FIG. 12 is a perspective exploded view showing these outer case 2, inner case 3 and cover 6. Configurations or structures of the outer case 2, the inner case 3 and the cover 6 are not basically different from those of the first embodiment.

Figure 13A:
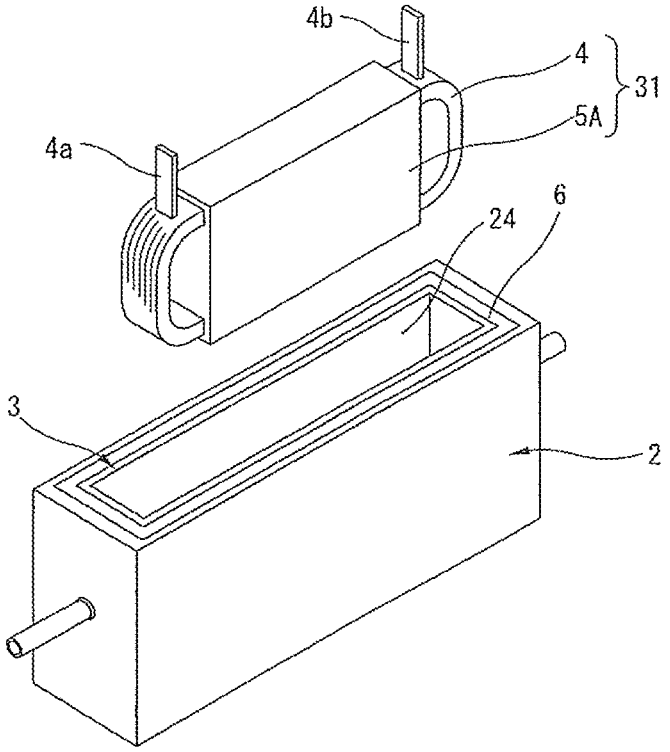
FIGS. 13A and 13B are explanatory drawings showing a manufacturing process of the reactor of the second embodiment.
Figure 13B:
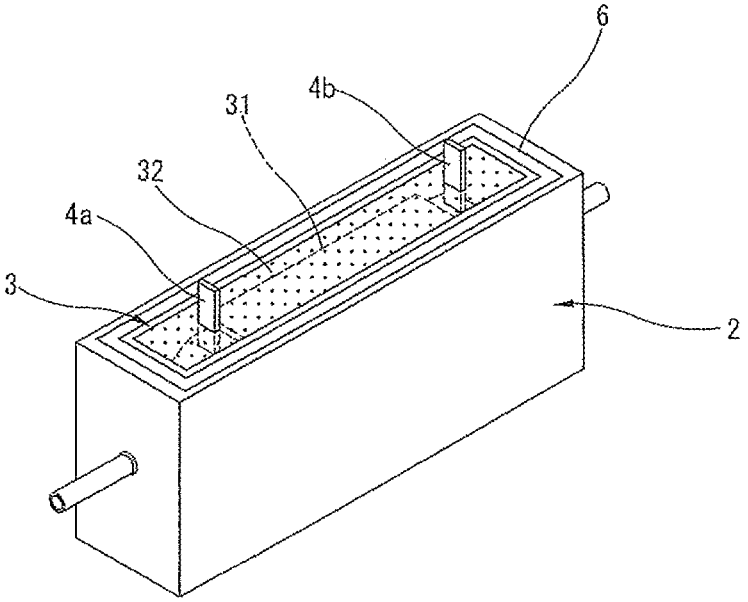

In the second embodiment, a reactor assembly 31 including the coil 4 and a core 5A is accommodated in the inner case 3. FIGS. 13A and 13B are explanatory drawings showing an example of a manufacturing process of the reactor 1 of the second embodiment. As shown in FIGS. 13A and 13B, the coil 4 is not particularly different from the above coil 4 of the first embodiment, and so-called flat-type wire is helically wound in a radial direction along a substantially flat rectangular shape without overlapping. The core 5A around which this coil 4 is wound could be, e.g. a general laminated steel sheet core (or a general laminated steel plate core), or may be so-called dust core (or a pressed powder core) molded into a predetermined shape using magnetic powder coated with binder resin. A shape of the core 5A is not particularly limited. For instance, the core 5A is formed into a flat rectangular outside shape so as to correspond to the above flat shape of the coil 4. The core 5A is formed such that an inner peripheral side of the coil 4 is embedded and also outer peripheries of long side parts of the flat coil 4 are enclosed.

In the same manner as the coil 4 of the first embodiment, both ends of the wire of the coil 4 are led out as the terminals 4*a* and 4*b*. These two terminals 4*a* and 4*b* are positioned apart from each other at both end portions in a longitudinal direction of the coil 4 having a long narrow shape as a whole, and extend parallel to each other. The terminals 4*a* and 4*b* are arranged at positions that do not interfere with the core 5A.

Such reactor assembly 31 including the coil 4 and the core 5A has a size that can pass through the opening surface 24 of the inner case 3. As shown in FIG. 13A (step A), the reactor assembly 31 is inserted in the inner case 3 through the opening surface 24, and placed in the inner case 3 with the pair of terminals 4*a* and 4*b* protruding from the opening surface 24. Then, as shown in FIG. 13B (step B), the inner case 3 is filled with potting material 32 having thermal conductivity and insulation property so that the reactor assembly 31 except the terminals 4*a* and 4*b* is embedded. As the potting material 32, for instance, epoxy-based potting material etc., which is generally commercially available as potting material for a circuit board, can be used. This potting material 32 is in liquid form having proper fluidity when not cured, and the potting material 32 is cured by application of heat in a heating furnace after the inner case 3 is filled with the potting material 32. As the potting material 32, two-liquid mixture type containing a main agent and a curing agent could be used.

Here, order of two steps of assembly of the cases 2 and 3 and filling of the potting material 32 is arbitrarily determined. That is, after assembling the outer case 2 and the inner case 3, the reactor assembly 31 could be placed in the inner case 3 and the inner case 3 could be filled with the potting material 32 (see FIGS. 13A and 13B). Alternatively, after placing the reactor assembly 31 in the inner case 3 and filling the inner case 3 with the potting material 32, this inner case 3 and the outer case 2 could be assembled. In a case of the embodiment in which the outer case 2 and the inner case 3 are integrated by the cover 6 being welded or brazed, after integrating the outer case 2 and the inner case 3, insertion or installation of the reactor assembly 31 and filling of the potting material 32 are carried out.

In the reactor 1 structured as described above, one of the refrigerant pipe connecters 15 of the outer case 2 serves as the refrigerant inlet, and the other serves as the refrigerant outlet, then the cooling water forcibly flows by the pump (not shown). Flows of the cooling water in the reactor 1 are the same as those explained on the basis of FIGS. 7A and 7B. The cooling water flowing into the reactor 1 from the refrigerant inlet radially expands in the refrigerant flow passage 27 between the one end wall 11 of the outer case 2 and the one end wall 21 of the inner case 3. The cooling water further flows in the refrigerant flow passages 27 between the side walls 12 of the outer case 2 and the side walls 22 of the inner case 3 and between the bottom wall 13 of the outer case 2 and the bottom wall 23 of the inner case 3 along the longitudinal directions of these cases 2 and 3. Then, the cooling water flows in the refrigerant flow passage 27 between the other end wall 11 of the outer case 2 and the other end wall 21 of the inner case 3, and flows out of the reactor 1 through the refrigerant outlet. That is, the cooling water flows along the respective five surfaces, except the opening surfaces 14 and 24 where the terminals 4*a* and 4*b* are arranged, of the cases 2 and 3, and effectively cools the reactor assembly 31 which is enclosed with these five surfaces. In particular, in this second embodiment, since the potting material 32 is in absolute contact with inner wall surfaces of the inner case 3 and heat is surely transferred to the cooling water through the inner case 3, the heat is effectively recovered. In addition, the inner case 3 is provided with the cooling fins 25, and thus a heat exchange area between the inner case 3 and the cooling water becomes large, thereby improving heat transfer from the inner case 3 to the cooling water. Further, since outside surfaces of the outer case 2 are substantially thermally insulated from the inner case 3 by the refrigerant flow passages 27, temperature of any of the outside surfaces except the opening surface 14 of the outer case 2 becomes lower. Therefore, thermal influence on other components that are adjacent to the reactor 1 is reduced.

Also in the second embodiment, since the side surfaces each having the relatively narrow width, out of respective four side surfaces extending along the longitudinal direction of the rectangular parallelepiped shapes of the cases 2 and 3, are the opening surfaces 14 and 24, an area of a portion having no refrigerant flow passage 27 becomes the minimum. In other words, an area of a surface covered with the refrigerant flow passages 27 is increased to the maximum, and the coil 4 and the core 5A are effectively cooled, and also heat radiation to the outside is reduced. As mentioned above, for the reactor 1 for the vehicle, even though the coil 4 is a heating element (a heat generator) and also a surrounding atmosphere (ambient temperature) becomes high, since the cooling water flows in a wide area, it is possible to maintain the coil 4 and the outer case 2 at relatively low temperature.

It is noted that just as modification is possible in the first embodiment, configurations or structures of the surface of the inner case 3 on which the cooling fins 25 are provided and the refrigerant pipe connecter 15, etc. can be modified.

Figure 14:
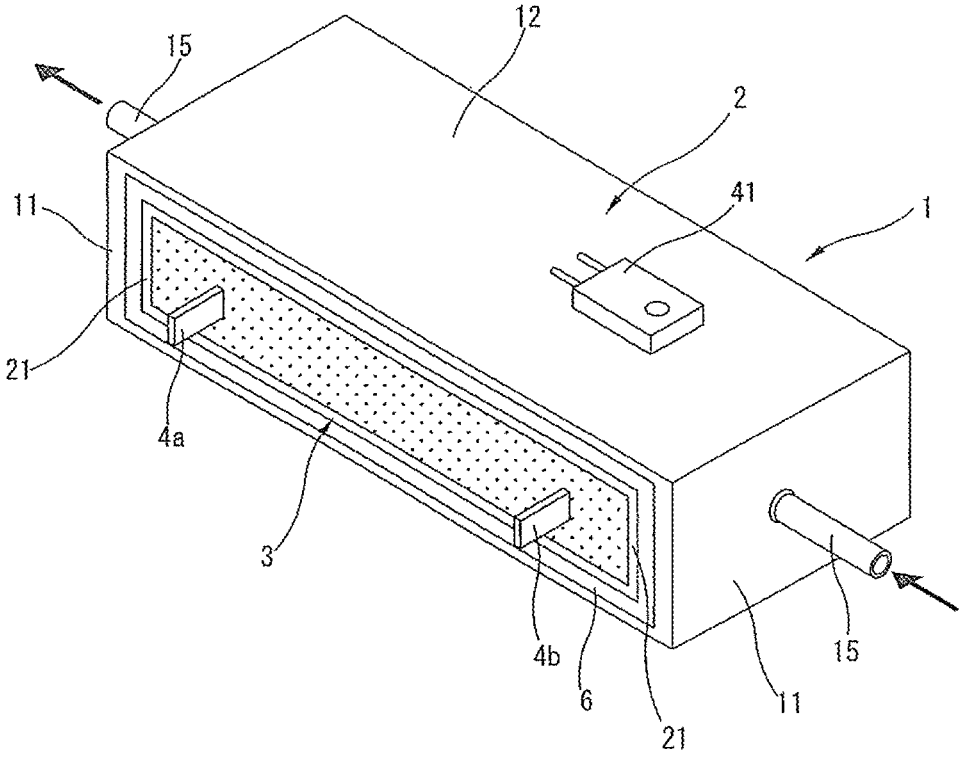
FIG. 14 is a perspective view of a modified example in which other electronic component is attached to an outside surface of the outer case.

Next, FIG. 14 shows a modified example of the reactor 1 of the first embodiment or the second embodiment. In this example, a relatively small-sized other electronic component 41, which is preferably cooled, is attached to the outside surface of the outer case 2. As the electronic component 41, it could be a heat-generating component such as a resistor, or may be a certain electronic component which in itself does not generate much heat, but has relatively low heat resistance then needs cooling against temperature (ambient temperature) of the atmosphere. In the illustrated example, the electronic component 41 is attached to the side wall 12 where an area of the refrigerant flow passage 27 formed inside is the widest. The electronic component 41 is particularly arranged at a closer side to the refrigerant inlet where cooling water temperature is relatively low from among positions in the longitudinal direction of the outer case 2.

As described above, since the outer case 2 is made of metal such as aluminum alloy that is excellent in heat conduction, an exchange of heat between the cooling water and the electronic component 41 is possible through the outer case 2. The electronic component 41 disposed outside is then cooled by the flow of the cooling water, besides the coil 4 etc. disposed inside. Especially in such a use environment that temperature (ambient temperature) of the surrounding atmosphere reaches, e.g. as much as 100° C., since the cooling water temperature is lower than the temperature (ambient temperature) of the atmosphere, effective cooling of the electronic component 41 is achieved by the cooling water. Although FIG. 14 illustrates one electronic component 41, a plurality of electronic components 41 can be attached to the outer case 2 if necessary.

Here, in a case where the outer case 2 is used as a kind of cooling plate as shown in FIG. 14, it is preferable for the outer case 2 to be made of material that is excellent in heat conduction, whereas in the other cases, the outer case 2 is not necessarily a member that is excellent in heat conduction. Therefore, in each of the first and second embodiment, the outer case 2 could be made of, e.g. hard synthetic resin.

Next, a third embodiment of the reactor 1 will be explained. Since a basic configuration or structure of the reactor 1 of the third embodiment is the same as that of the reactor 1 of the first embodiment or the second embodiment, drawing(s) is omitted here. In the third embodiment, as the refrigerant flowing in the refrigerant flow passages 27, cooling oil having insulation property, namely, insulating oil, is used. For instance, insulating oil containing mineral oil as a main component is used. The insulating oil forcibly flows in the refrigerant flow passages 27 between the outer case 2 and the inner case 3 by an oil pump.

According to a configuration using such insulating oil as the refrigerant, as compared with a case where the cooling water containing water as a main component is used, oil is superior to water in heat conduction. Therefore, a cooling effect on the coil 4 of the first embodiment and the reactor assembly 31 of the second embodiment is higher. Further, in the case where the outer case 2 and the inner case 3 are made of metal, corrosion of a contact surface with the refrigerant hardly occurs.

Figure 15:
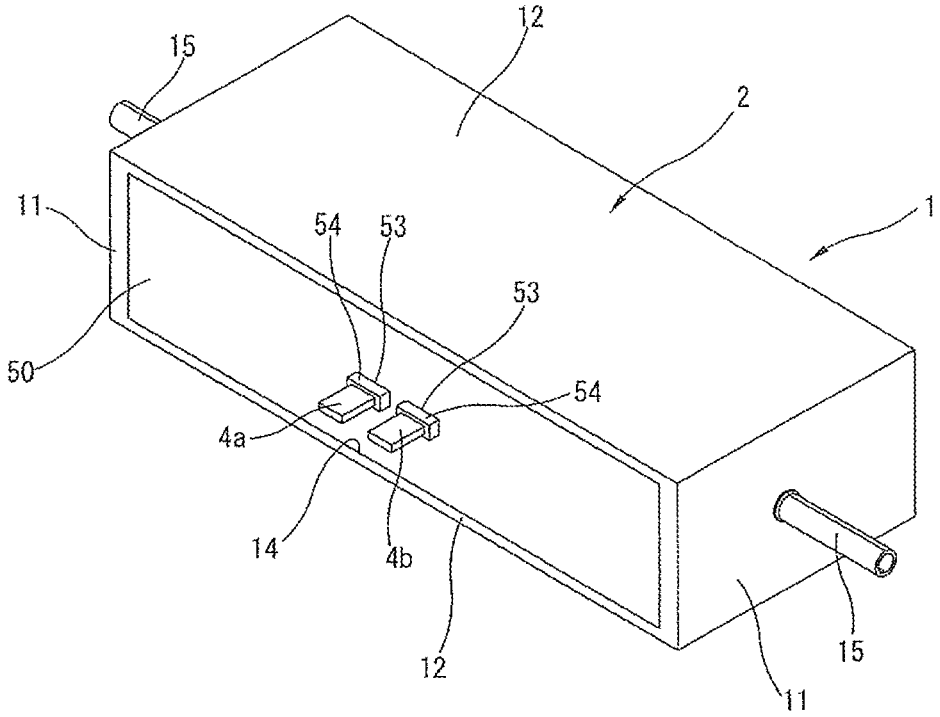
FIG. 15 is a perspective view showing a fourth embodiment of the reactor.
Figure 16:
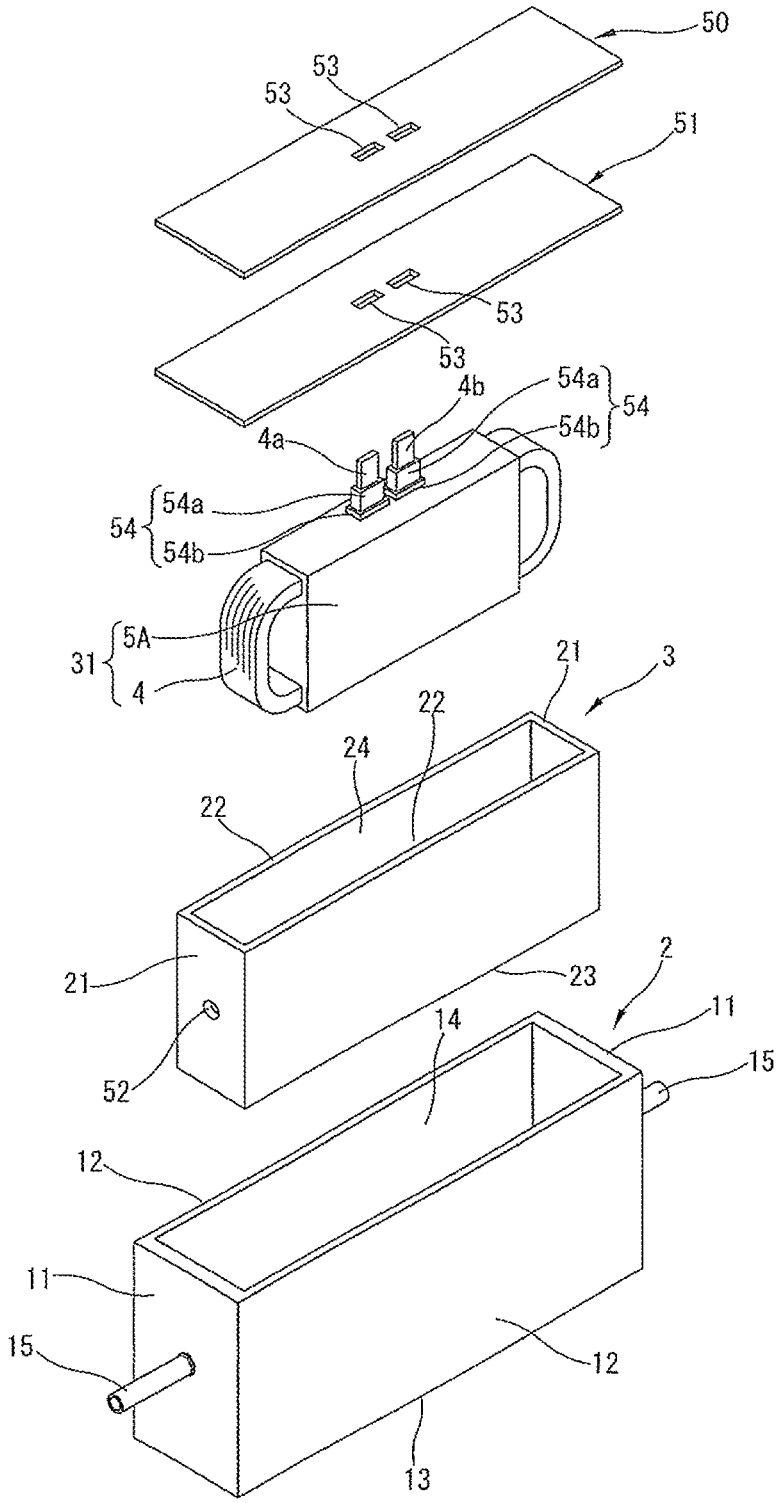
FIG. 16 is a perspective exploded view of the reactor of the fourth embodiment.

Next, a fourth embodiment of the reactor 1 will be explained with reference to FIGS. 15 and 16. In this fourth embodiment, instead of the above potting material 32 of the second embodiment, an inside of the inner case 3 is filled with the insulating oil serving as the refrigerant. That is, in the same manner as the second embodiment, the reactor 1 has the outer case 2 having a rectangular parallelepiped shape, the inner case 3 having a similar rectangular parallelepiped shape and accommodated in the outer case 2 and the reactor assembly 31 placed in the inner case 3. Further, instead of the frame-shaped cover 6, a rectangular plate-shaped first lid member 50 and a rectangular plate-shaped second lid member 51 are provided.

The outer case 2 is made of metal, preferably metal that is excellent in heat conduction. The outer case 2 is formed as a single-piece case by, e.g. cutting or aluminum die casting of aluminum alloy base material. The outer case 2 has a box shape whose one side surface out of six surfaces forming the rectangular parallelepiped is open. That is, the outer case 2 has the pair of end walls 11 forming end surfaces of both ends in a longitudinal direction of the outer case 2, the pair of side walls 12 forming side surfaces each having a relatively wide width, the bottom wall 13 forming a side surface having a relatively narrow width and the opening surface 14 corresponding to a side surface having the relatively narrow width and facing the bottom wall 13. Further, the first lid member 50 is fixed to the opening surface 14.

The refrigerant pipe connecters 15, one of which serves as the refrigerant inlet and the other of which serves as the refrigerant outlet, are connected to center portions of the pair of end walls 11. These refrigerant pipe connecters 15 each have a circular tubular shape extending along the longitudinal direction of the outer case 2, and are connected to an insulating oil circulation system (not shown) including an oil pump (not shown).

In the same manner as the outer case 2, the inner case 3 is made of metal, preferably metal that is excellent in heat conduction. The inner case 3 is formed as a single-piece case by, e.g. cutting or aluminum die casting of aluminum alloy base material. The inner case 3 has the rectangular parallelepiped shape that is substantially a similar figure to the outer case 2 and smaller than the outer case 2. In the same manner as the outer case 2, the inner case 3 is formed into a box shape whose one side surface out of six surfaces forming the rectangular parallelepiped is open. That is, the inner case 3 has the pair of end walls 21 forming end surfaces of both ends in a longitudinal direction of the inner case 3, the pair of side walls 22 forming side surfaces each having a relatively wide width, the bottom wall 23 forming a side surface having a relatively narrow width and the opening surface 24 corresponding to a side surface having the relatively narrow width and facing the bottom wall 23. Here, in the illustrated example, the cooling fins 25 as shown in the first embodiment are not provided. However, in the same manner as the first embodiment, the cooling fins 25 could be provided on the surfaces of the pair of side walls 22 and the bottom wall 23.

Each of the pair of end walls 21 is provided with a communication hole 52 through which the insulating oil can flow. The communication hole 52 is, for instance, a circular hole. Each communication hole 52 is formed at a substantially center position of the end wall 21.

The opening surface 24 of the inner case 3 is located at a surface corresponding to the opening surface 14 of the outer case 2. That is, in a state in which the outer case 2 and the inner case 3 are combined together, the opening surface 24 of the inner case 3 is positioned in the opening surface 14 of the outer case 2. Then, between the inner case 3 and the outer case 2 at the respective five surfaces except these opening surfaces 14 and 24, gaps serving as the refrigerant flow passages 27 are formed. In other words, the outer case 2 encloses outer sides of the five surfaces except the opening surface 24 of the inner case 3, and the refrigerant flow passages 27 are formed at the respective surfaces. The second lid member 51 is fixed to the opening surface 24 of the inner case 3.

The first lid member 50 and the second lid member 51 overlap each other with the first lid member 50 located on an outer side, and the second lid member 51 is connected to the opening edge of the inner case 3 (e.g. by welding or brazing) and covers the opening surface 24 of the inner case 3, and further the first lid member 50 is connected to the opening edge of the outer case 2 (e.g. by welding or brazing) and covers the opening surface 14 of the outer case 2, i.e. openings at upper ends of the refrigerant flow passages 27. For instance, as an example, each of the first lid member 50 and the second lid member 51 is formed from a metal plate whose material is same as those of the outer case 2 and the inner case 3, and the first lid member 50 and the second lid member 51 are fixed to the opening edges of the outer case 2 and the inner case 3 respectively by welding or brazing.

The first lid member 50 and the second lid member 51 each have a pair of terminal openings 53 for leading out the terminals 4*a* and 4*b* of the coil 4. These pair of terminal openings 53 are formed into, e.g. a rectangular shape.

The reactor assembly 31 accommodated in the inner case 3 includes the coil 4 and the core 5A, which is the same as the second embodiment. The coil 4 has a structure in which so-called flat-type wire is helically wound in a radial direction along a substantially flat rectangular shape without overlapping. The core 5A is, e.g. a general laminated steel sheet core (or a general laminated steel plate core), or so-called dust core (or a pressed powder core) obtained by molding magnetic powder into a predetermined shape.

Both ends of the coil 4 are led out as the terminals 4*a* and 4*b*. In the illustrated example, arrangement of the terminals 4*a* and 4*b* is slightly different from that of the second embodiment. The terminals 4*a* and 4*b* are arranged at the middle in the longitudinal direction of the coil 4 having a long narrow shape as a whole.

At base portions of the terminals 4*a* and 4*b*, seal caps 54 that are fitted to the terminal openings 53 of the first lid member 50 and the second lid member 51 are provided. The seal caps 54 are molded with rubber or synthetic resin material which have proper elasticity. The seal caps 54 each have a prism portion (or a rectangular-column portion) 54*a* that can be press-fitted into the terminal opening 53 and a flange portion 54*b* that is pressure-welded (or press-connected) to an inside surface of the second lid member 51. Here, the seal caps 54 could be molded with the terminals 4*a* and 4*b* being inserted, and after the molding, the terminals 4*a* and 4*b* could be inserted into the terminal openings 53. The seal caps 54 are tightly fixed to the terminal openings 53 of the first lid member 50 and the second lid member 51, then gaps between the terminals 4*a* and 4*b* led out by penetrating the first and second members 50 and 51 and the first and second members 50 and 51 are sealed.

In the reactor of the fourth embodiment structured as described above, one of the refrigerant pipe connecters 15 of the outer case 2 serves as the refrigerant inlet, and the other serves as the refrigerant outlet, then the insulating oil serving as the refrigerant forcibly flows by the pump (not shown). In the same manner as the flow explained in FIG. 7 in the first embodiment, the insulating oil flows in the refrigerant flow passages 27, and cools the inner case 3. Further, at the same time, the insulating oil flows into the inner case 3 through the pair of communication holes 52, and the inside of the inner case 3 in which the reactor assembly 31 is accommodated is filled with the insulating oil. Since the insulating oil has insulation property and thermal conductivity, which is the same as the potting material 32 of the second embodiment, the insulating oil transfers or conducts heat of the reactor assembly 31 to the inner case 3 while insulating the reactor assembly 31. With this, the reactor assembly 31 is effectively cooled. In addition, working and effects described in the first embodiment etc. can be obtained. Since the inside of the inner case 3 and the refrigerant flow passages 27 communicate with each other through the communication holes 52, the insulating oil flowing into the inner case 3 does not stay or remain, and thus does not deteriorate. Here, since the insulating oil filling the inside of the inner case 3 is basically a substitute for the potting material 32 of the second embodiment, the insulating oil filling the inside of the inner case 3 does not need to flow at such a sufficient flow speed that the insulating oil flows in the refrigerant flow passages 27.

The fourth embodiment has the advantage of eliminating the need for the filling step of the potting material 32 of the second embodiment.

In the fourth embodiment, although the overlapping two lid members 50 and 51 are provided, one plate-shaped lid member could cover both of the opening surface 24 of the inner case 3 and the upper end openings, located at an outer peripheral side of the opening surface 24, of the refrigerant flow passages 27. For instance, after welding (or brazing) the lid member (whose shape is substantially similar to the shape of the first lid member 50) formed from a metal plate whose material is same as those of the outer case 2 and the inner case 3 to the opening edge of the inner case 3, the inner case 3 is installed or placed in the outer case 2, then finally, the opening edge of the outer case 2 and the lid member are welded (or brazed). With this, the lid member can cover the inner case 3 and the refrigerant flow passages 27, and the outer case 2 and the inner case 3 can be integrated by the lid member.

The invention claimed is:

1. A reactor comprising:

a box-shaped inner case whose one side surface is an opening surface;

an outer case enclosing outer sides of surfaces except the opening surface of the inner case, forming gaps that serve as refrigerant flow passages between the inner case and the outer case and provided with a refrigerant inlet and a refrigerant outlet;

a coil placed in the inner case through the opening surface, terminals at both ends of the coil being arranged at the opening surface; and a core made of magnetic powder mixture resin that fills the inner case so that the coil except the terminals is embedded.

2. The reactor as claimed in claim 1, wherein the inner case and the outer case each have a rectangular parallelepiped box shape, one side surface, corresponding to the opening surface of the inner case, of the outer case is an opening surface, and the inner case can be installed in the outer case through the opening surface of the outer case, and the refrigerant inlet is provided at one end portion in a longitudinal direction of the outer case, and the refrigerant outlet is provided at the other end portion of the outer case.

3. The reactor as claimed in claim 2, further comprising:

a frame-shaped cover fixed to the one side surface, serving as the opening surface, of the outer case and covering a gap between the opening surface of the outer case and the inner case.

4. The reactor as claimed in claim 1, wherein a cooling fin is provided at least at a part of outside surfaces, which are in contact with the refrigerant flow passages, of the inner case.

5. The reactor as claimed in claim 1, wherein a refrigerant is cooling water or insulating oil.

6. A reactor comprising:

a box-shaped inner case whose one side surface is an opening surface;

an outer case enclosing outer sides of surfaces except the opening surface of the inner case, forming gaps that serve as refrigerant flow passages between the inner case and the outer case and provided with a refrigerant inlet and a refrigerant outlet;

a reactor assembly placed in the inner case through the opening surface and including a coil and a core, terminals at both ends of the coil being arranged at the opening surface; and a thermal conductive potting material filling the inner case so that the coil except the terminals is embedded.

7. The reactor as claimed in claim 6, wherein the inner case and the outer case each have a rectangular parallelepiped box shape, one side surface, corresponding to the opening surface of the inner case, of the outer case is an opening surface, and the inner case can be installed in the outer case through the opening surface of the outer case, and the refrigerant inlet is provided at one end portion in a longitudinal direction of the outer case, and the refrigerant outlet is provided at the other end portion of the outer case.

8. The reactor as claimed in claim 7 further comprising:

a frame-shaped cover fixed to the one side surface, serving as the opening surface, of the outer case and covering a gap between the opening surface of the outer case and the inner case.

9. The reactor as claimed in claim 6, wherein a cooling fin is provided at least at a part of outside surfaces, which are in contact with the refrigerant flow passages, of the inner case.

10. The reactor as claimed in claim 6, wherein a refrigerant is cooling water or insulating oil.

11. A reactor comprising:

a box-shaped inner case whose one side surface is an opening surface and which is filled with insulating oil serving as a refrigerant and has a communication hole through which the insulating oil can flow;

an outer case enclosing outer sides of surfaces except the opening surface of the inner case, forming gaps that serve as refrigerant flow passages between the inner case and the outer case and provided with a refrigerant inlet and a refrigerant outlet;

a reactor assembly placed in the inner case through the opening surface and including a coil and a core, terminals of the coil being arranged at the opening surface; and a lid member covering the opening surface with the terminals being led out.

* * * * *